US010728989B2

(12) United States Patent
Aliakseyeu et al.

(10) Patent No.: US 10,728,989 B2
(45) Date of Patent: Jul. 28, 2020

(54) LIGHTING SCRIPT CONTROL

(71) Applicant: SIGNIFY HOLDING B.V., Eindhoven (NL)

(72) Inventors: Dzmitry Viktorovich Aliakseyeu, Eindhoven (NL); Jacobus Dingenis Machiel Van Boven, Eindhoven (NL); Remco Magielse, Tilburg (NL); Gerardus Wilhelmus Theodorus Van Der Heijden, Haaren (NL)

( * ) Notice: Subject to any disclaimer, the term of this patent is extended or adjusted under 35 U.S.C. 154(b) by 0 days.

(21) Appl. No.: 16/490,636

(22) PCT Filed: Feb. 26, 2018

(86) PCT No.: PCT/EP2018/054636

§ 371 (c)(1),
(2) Date: Sep. 3, 2019

(87) PCT Pub. No.: WO2018/158178

PCT Pub. Date: Sep. 7, 2018

(65) Prior Publication Data

US 2020/0022238 A1 Jan. 16, 2020

(30) Foreign Application Priority Data

Mar. 2, 2017 (EP) ..... 17158825

(51) Int. Cl.

| | |
|---|---|
| ***G05F 1/00*** | (2006.01) |
| ***H05B 39/00*** | (2006.01) |
| ***H05B 47/155*** | (2020.01) |

(52) U.S. Cl.
CPC ..... *H05B 47/155* (2020.01)

(58) Field of Classification Search
CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927;
(Continued)

(56) References Cited

U.S. PATENT DOCUMENTS

| | | | | |
|---|---|---|---|---|
| 8,912,727 | B1 | 12/2014 | Brunell et al. | |
| 9,070,249 | B2 * | 6/2015 | Radek | G07F 17/3223 |
| 10,269,207 | B2 * | 4/2019 | Gronkowski | G07F 17/3225 |

(Continued)

*Primary Examiner* — Minh D A
(74) *Attorney, Agent, or Firm* — Meenakshy Chakravorty

(57) ABSTRACT

A controller for a lighting system, the lighting system comprising one or more luminaires associated with a lighting channel; the controller comprising: a script interpreter configured to interpret a lighting script for rendering on the luminaires; an effect impact determining module configured to determine a visual impact level of each of the lighting effects if rendered as defined by the lighting script unmodified; a script modifier configured to selectively generate, based on the visual impact levels, effect modification data for modifying the visual impact level of at least one of the lighting effects; a lighting controller configured to control the luminaires associated with the lighting channel to render versions of the lighting effects defined by the lighting script, wherein the lighting controller is configured to use the effect modification data to render a modified version of the at least one lighting effect having the modified visual impact level.

13 Claims, 10 Drawing Sheets

(58) Field of Classification Search
CPC .. H05B 37/029; H05B 37/0254; H05B 37/02; Y02B 20/202
See application file for complete search history.

(56) References Cited

U.S. PATENT DOCUMENTS

| | | | |
|---|---|---|---|
| 2010/0213877 | A1 | 8/2010 | Galeazzi |
| 2010/0231140 | A1 | 9/2010 | Aarts |
| 2010/0244745 | A1 | 9/2010 | Wendt |
| 2010/0318201 | A1 | 12/2010 | Cuppen et al. |
| 2011/0109250 | A1 | 5/2011 | Engelen |
| 2013/0147395 | A1 | 6/2013 | Cook |
| 2015/0206553 | A1 | 7/2015 | Cheng et al. |
| 2015/0262455 | A1 | 9/2015 | Radek et al. |
| 2018/0236354 | A1 | 8/2018 | Van Boven et al. |
| 2019/0099668 | A1 | 4/2019 | Aliakseyeu et al. |

* cited by examiner

LIGHTING SCRIPT CONTROL

CROSS-REFERENCE TO PRIOR APPLICATIONS

This application is the U.S. National Phase application under 35 U.S.C. § 371 of International Application No. PCT/EP2018/054636, filed on Feb. 26, 2018, which claims the benefit of European Patent Application No. 17158825.4, filed on Mar. 2, 2017. These applications are hereby incorporated by reference herein.

TECHNICAL FIELD

The present disclosure relates to rendering lighting effects based on a lighting script to enhance an entertainment experience.

BACKGROUND

Light can be used to enhance entertainment experiences such as audio-visual media. A well-known add-on of light to video content is technology which augments the video experience for a user/viewer by controlling nearby luminaires to create lighting effects which are perceivable by the user and appear to match the video (e.g. the same color as the overall image at a point in time). These effects can be dynamics. To provide such effects, some hardware such as TVs are also being fitted with built-in luminaires.

Note that in this context, the terms "luminaire", "light source", "lamp" may be used interchangeably to refer to the individually controllable pieces of hardware within an environment which act as sources of illumination.

With the rise of smart home technologies, and in specific smart lighting, colored and dynamic lighting can be used to enhance home entertainment experiences in a complete environment. Light effects can be rendered throughout an entire room, immersing people into their entertainment experiences even further.

Light effects to accompany entertainment experiences are commonly specified in "light scripts". A light script (also called a "lighting script", or just "script") is a data structure defining particular lighting effects to be rendered by one or more luminaires over a time period. The light script is accessed by the lighting system to "play" it alongside the entertainment experience, by interpreting it to control the luminaires of the lighting system in accordance with the effects defined in the lighting script. This is somewhat analogous to the overlay of subtitles on a movie.

Document D1 (US 2011/0109250 A1) discloses a method for lighting experience translation comprising receiving an effect based script and one or more location-effect control models where the script describes one or more light effects of the lighting experience on one or more locations in a view in an environment and a location-effect control model describes light effects being available on a location in the view in the environment. The method translates the effect based script into controls for one or more virtual lighting devices by using the location effect control model which allows to design lighting infrastructure independent effect based scripts.

Document D2 (US 2010/0318201 A1) discloses a method comprising transmitting an operate signal from a control system to a lighting device, operating the lighting device according to the operating signal, detecting an effect of the lighting device, assigning a location to said effect, and storing the location of said effect. The effects device can comprise a lighting device, and the method can be repeated

SUMMARY

When light is used to enhance (video) entertainment content being displayed on a screen, the effects must match the content on the screen. However the diversity of lighting setups (i.e. the particular placement and number of luminaires) in people's homes makes it difficult to create a dedicated script for every setup, so instead a generic script needs to be created to be matched on any setup. Such generic script can be written from the view of a user having a most common setup e.g. three light sources with two on the left and right of the TV and one like led strip in the center. But there are several questions which arise from this: what if the user has much more light sources? What if user has 5 light sources on the left and one on the right? How can the effects be up-scaled and how should the timing of the effect be addressed?

In other words, there is a problem when attempting to play a lighting script on a user's lighting system which comprises many luminaires. Such a user system may comprise tens, or even hundreds of luminaires. How to adapt the script to deal with this is not obvious. For example, a designer of the script may have had a single luminaire in mind and defined a particular effect in the script as "100% brightness white light". This may be an acceptable rendering for a single luminaire, but if a user's system contains, for example, 20 luminaires, having them all output 100% brightness white light at the same time might be blindingly bright.

Embodiments of the present invention solve the above problem by augmenting the functionality of a traditional script interpreter so that it is able to take into account the particular user setup (number and placement of luminaires) to avoid badly rendered effects, as in the above example.

Hence, according to one aspect disclosed herein, there is provided a controller for a lighting system, the lighting system comprising one or more luminaires associated with a lighting channel; the controller comprising: an input for receiving a lighting script defining lighting effects to be rendered on the lighting channel; a script interpreter configured to interpret the lighting script for rendering on the luminaires; an effect impact determining module configured to determine a visual impact level of each of the lighting effects if rendered by the plurality of luminaires associated with the lighting channel as defined by the lighting script unmodified; a script modifier configured to selectively generate, based on the visual impact levels, effect modification data for modifying at least one of the lighting effects to modify its visual impact level; a lighting controller configured to control the luminaires associated with the lighting channel to render versions of the lighting effects defined by the lighting script, wherein the lighting controller is configured to use the effect modification data to render a modified version of the at least one lighting effect having the modified visual impact level from at least one of the luminaires.

The process of modifying the lighting effects, when resulting in the effect being render on more luminaires than defined in the script, may be referred to as "upscaling" the lighting effect. Similarly, "downscaling" refers to the effect being rendered on fewer luminaires than was intended (as defined in the script).

A basic lighting script may simply define an effect to be rendered by any luminaire on a channel inherently i.e. without specifying the number of luminaires. This can be downscaled by instead rendering it on only a (sub)set of one or more of the luminaires on the channel. A more detailed lighting script may explicitly define a number of luminaire (s) on the channel to render an effect, which can be upscaled or downscaled. In this respect, the term "one or more luminaires associated with a lighting channel" can mean all luminaire(s) on a channel or a (sub)set of the luminaire(s) defined by the script.

For at least one of the lighting effects, the version rendered can be the original version i.e. unmodified (i.e. as defined by the lighting script when interpreted literally). However, in the present invention, a modified version of at least one of the effects (e.g. using only a subset of the luminaires on the channel, or altering a color, brightness, dynamic property of the effect etc.) can be rendered for example when the visual impact of the original effect would be overwhelming to a human visual system (i.e. reducing its visual impact level in that event). That is, when literal interpretation of the lighting script for that effect risks overwhelming a user, for example because of the number, size and/or maximum brightness capabilities of the luminaires on that channel etc.

The term "visual impact level" means an expected effect on a user as perceived by the user's human visual system (HVS) due to the extent to which it is expected to stimulate the HVS. That is, how noticeable the effect is by the user. Factors which affect the visual impact level are factors which are perceivable by a human user and affect the way in which the user's attention is drawn to the effect. These include: the number of luminaires, the locations of those luminaires, brightness, color, and dynamic effects (flashing, fading etc.).

In extreme cases, a light effect may have an excessive visual impact level that is unpleasant for a user, due to excessive stimulation of the HVS. In that event, the effect can be modified to reduce its visual impact to a comfortable level.

In a simple case, the visual impact level is the total power output by the luminaire(s) rendering the effect. This can be calculated from the power output of each individual luminaire (based on the brightness to be rendered, as defined in the script) summed over the luminaires which will render the effect. The visual impact in this case can then be reduced by decreasing either the brightness of the effect or the number of luminaires on which is it rendered (and can be increased by increasing the brightness of the effect or the number of luminaires on which it is rendered).

How each factor affects the visual impact level of an effect can be relative to other effects and/or ambient lighting within the environment. For example, an effect comprising blue lighting will be less impactful (noticeable by the user) in a blue environment than a yellow environment. Hence, the impact determining module may first determine a light level (ambient light level, potentially including effects from the luminaires themselves) within the room, and then determine the impact taking this knowledge into account. The light level can be determined by explicit detection, e.g. using a photo sensor, or determined implicitly from other data such as the current setting(s) of the luminaires in the room. The impact is then determined based on this "background" level by determining how "different" the effect to be rendered is (or will be) from the background. "Different" here can refer to a difference in any one or more of brightness, color, saturation (or other components of color) etc. As a specific example, the lighting system may comprise a presence sensor that can measure a light level within the room, so during the entertainment session the system is able to read the light level from the sensor. Some entertainment devices (as described herein), and user device (e.g. smart phones), comprise cameras or other sensors which could also be used to determine properties of the background light level. Data pertaining to the light level as detected by such devices can be transmitted to the controller via a wireless communication means (e.g. WiFi) as known in the art.

In embodiments, the modification data are only generated if the set of the plurality of luminaires does not contain all of the luminaires on the channel. That is, upscaling is applied when at least one lighting effect in the received lighting script is mapped by default to a lower number of "virtual" luminaires (being only luminaries referred to in the script) than the number of real luminaires (actual physical luminaires of the system) to which the effect can be mapped in the user's setup. In other words: the opportunity to upscale is determined by the number of luminaries the light script requires being smaller than the number of luminaires available.

In embodiments, said modification data defines a modification to one or more of: a number of luminaires on from which the lighting effect is to be rendered by the lighting controller; a brightness of the lighting effect; a color of the lighting effect; a dynamic range of the lighting effect; a dynamic frequency of the lighting effect.

In embodiments, wherein said modified visual impact level is a reduced visual impact level.

In embodiments, the lighting system further comprises further pluralities of luminaires each associated with a respective lighting channel, the script defining lighting effects for each channel for which modification data are selectively generated.

In embodiments, the visual impact level of the lighting effect is based on one or more of: an angular position of the luminaires on the channel or the lighting effect if rendered by the luminaires relative to a field of view of the human user; an indication of an expected visual impact level specified in the lighting script; a type of the lighting effect; temporal dynamics of the lighting effect; a number of luminaires on the channel; an expected brightness of the lighting effect if rendered unmodified by the luminaires on the channel; or a physical size of the luminaires.

In embodiments, said determining one or more of the luminaires on which to render the lighting effect comprises selecting a greater number of luminaires if the lighting effect is determined to have a low visual impact level, and selecting a lower number of luminaires if the lighting effect is determined to have a higher visual impact level.

In embodiments, the scalability of the lighting effect is based on determining that the lighting effect can be scaled spatially and/or temporally based on one or more of: an indication in the lighting script that the lighting effect is scalable; identifying that the lighting effect is defined in the lighting script by a mathematical formula which can be extended to an arbitrary number of luminaires.

In embodiments, the visual impact level is a total power output by the luminaires if the lighting effect were rendered unmodified.

In embodiments, the modified total power output is a reduced total power output.

In embodiments, the script modifier is configured to only generate the effect modification data if the visual impact level of the lighting effect is above a threshold visual impact level.

According to a second aspect disclosed herein, there is provided a method of controlling a lighting system, the lighting system comprising one or more luminaires associated with a lighting channel; the method comprising: receiving a lighting script defining lighting effects to be rendered on the lighting channel; interpreting the lighting script for rendering on the luminaires; determining a visual impact level of each of the lighting effects if rendered by the plurality of luminaires associated with the lighting channel as defined by the lighting script unmodified; selectively generating, based on the visual impact levels, effect modification data for modifying at least one of the lighting effects to modify its visual impact level; controlling the luminaires associated with the lighting channel to render versions of the lighting effects defined by the lighting script, by using the effect modification data to render a modified version of the at least one lighting effect, having the modified visual impact level, from at least one of the luminaires.

In embodiments, said modification data defines a modification to one or more of: a number of luminaires on from which the lighting effect is to be rendered; a brightness of the lighting effect; a color of the lighting effect; a dynamic range of the lighting effect; a dynamic frequency of the lighting effect.

In embodiments, said modified visual impact level is a reduced visual impact level.

In embodiments, the lighting system further comprises further pluralities of luminaires each associated with a respective lighting channel, the script defining lighting effects for each channel for which modification data are selectively generated.

According to a third aspect disclosed herein, there is provided a computer program product comprising computer-executable code embodied on a computer-readable storage medium configured, so as when executed by one or more processing units, to perform the steps according to the method of the second aspect.

According to a fourth aspect disclosed herein, there is provided a controller for a lighting system, the lighting system comprising one or more luminaires associated with a lighting channel; the controller comprising: an input for receiving a lighting script defining lighting effects to be rendered on the lighting channel; a script interpreter configured to determine for at least lighting effect in the script a number of luminaries indicated by the lighting script for that effect to be rendered on; a scalability module configured to determine a number of available luminaires associated with said lighting channel; a script modifier configured to compare the available number of luminaires determined by the scalability module with the number of luminaires defined by the script, and to select one or more of the available luminaries for the lighting effect based on said comparison, the number of luminaires selected being different from the number indicated by the lighting script; a lighting controller configured to render the effect on the selected one or more luminaires.

In embodiments, the number of luminaires selected by the script modifier is greater than the number of luminaries indicated by the lighting script for that effect.

In embodiments, the number of luminaires selected by the script modifier is less than the number of luminaires indicated by the lighting script for that effect.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

Figure 1:
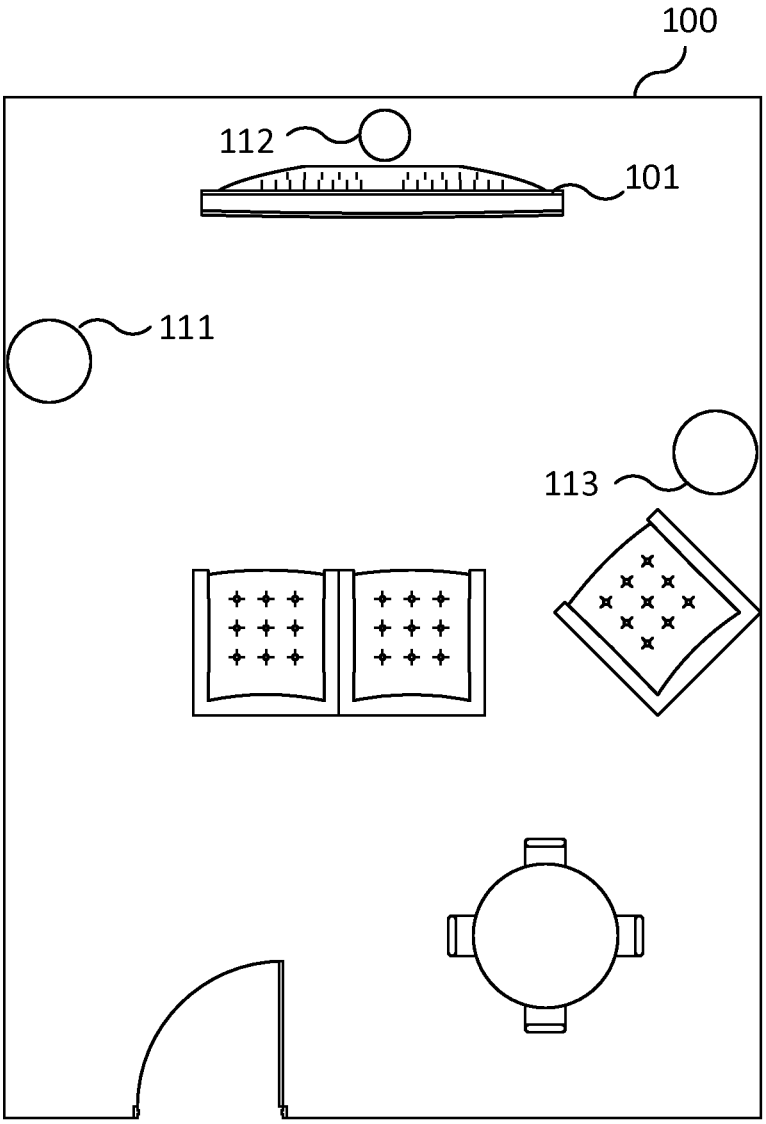
FIG. 1 shows a prior art home entertainment setup.

FIG. 1 shows a plan of an environment 100 such as a room in a user's house comprising an entertainment device 101 and a plurality of luminaires 111, 112, 113 (also called light sources, or lamps).

The entertainment device 100 may be a television for displaying video (and audio) content such as movies, television shows, video games etc. as shown in FIG. 1, or may be another entertainment device such as a screen capable of rendering only video (and not audio) or speakers capable of rendering only audio (and not video).

The luminaires 111-113 placed within the room 100 are traditionally there to provide illumination within the room 100, which is typically a static lighting effect (particularly if the luminaires are not capable of rendering different lighting effects, and can only be ON or OFF). However, the luminaires 111-113 may, as known in the art and shown in FIG. 1, be used to render lighting effects which accompany the video (or audio) content displayed on the entertainment device 101.

Figure 2:
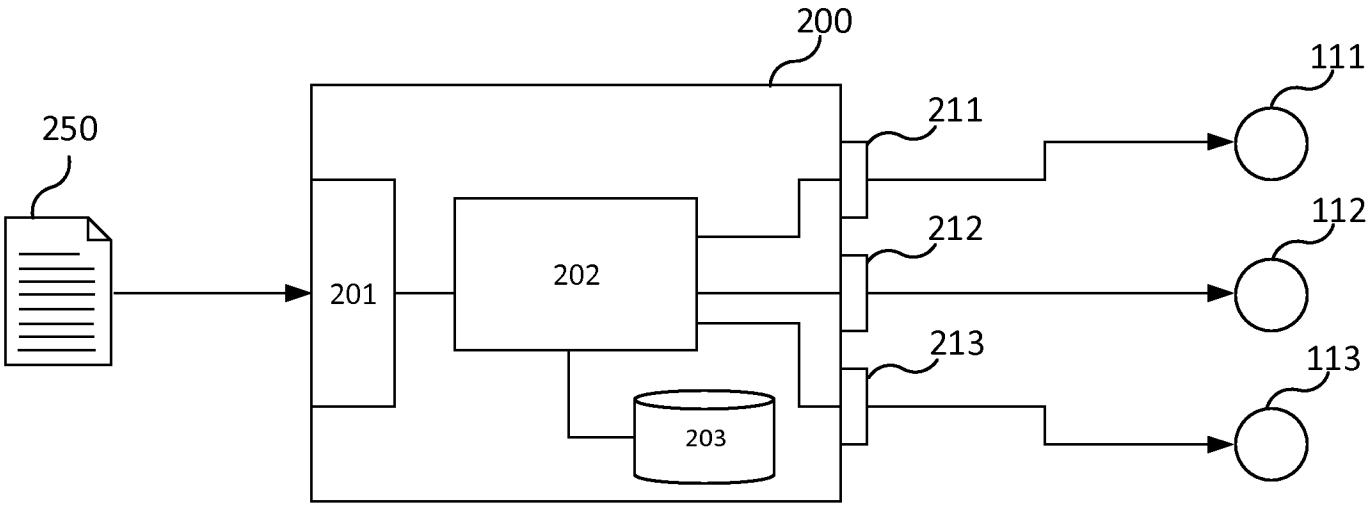
FIG. 2 is a schematic of a prior art lighting controller.

To do so, a lighting controller 200 is provided as shown in FIG. 2 which controls the luminaires 111-113 to render accompanying light effects.

The lighting controller 200 comprises an input 201, a processor 202, a memory 203, and one or more outputs (shows as three outputs 211-213 in FIG. 2). The processor 202 is operatively coupled to the input 201, the memory 202, and each of the outputs 211-213.

The input 201 comprises one or more network interfaces configured to at least receive (and optionally send) data from (to) a network. The network may be a wired or wireless network and hence it is appreciated that the input may comprise one or more wired or wireless interfaces such as one or more Ethernet, WiFi, Bluetooth, ZigBee etc. connections as appropriate.

The processor 202 comprises one or more processing units such as Application-Specific Integrated Circuits (ASICs), Field-Programmable Gate Arrays (FPGAs), etc. as known in the art in order to run computer-readable code to perform the functionality ascribed herein to the processor 202. For example, the processor 202 may comprise a single- or multi-core CPU.

The memory 203 comprises one or more memory units such as one or more solid state memories etc. as known in the art. Note that the computer-readable code mentioned above may be stored on memory 203 or may be stored on another memory not shown in FIG. 2 such as a local ROM.

Each output 211-213 comprises a respective data interface for at least sending (and optionally receiving) data to a respective luminaire 111-113. This data transmission from an output to a luminaire may be wired or wireless. For example, each output 211-213 may be directly wired to a respective luminaire 111-113 as shown in FIG. 2. This may be using separate wired connections, or using a single connection which "daisy chains" the luminaires 111-113 on an addressable connection, such as made possible by a DMX512 setup, as known in the art. One or more of the outputs 211-213 may be a wireless output configured to transmit data signals to its respective luminaire as wireless signals. For example, using a WiFi, Bluetooth, or Zigbee connection.

In operation, the processor 202 is configured to receive a lighting script 250 (described in more detail below) via the input 201 and to interpret the lighting script 250 by processing it to determine a respective lighting setting for each of the luminaires 111-113. The processor 202 then transmits these determined lighting settings to the respective luminaire 111-113, which receive their setting and alter their light output accordingly to render the instructed lighting setting. In this way, the lighting script 250 is "played out" by the luminaires 111-113 in the room 100. Hence, the controller 200 may be called a "lighting script interpreter".

The controller 200 may be implemented in a single element of the system such as in the entertainment device 101, or in one of the luminaires 111-113, or in a dedicated piece of hardware (not shown in FIG. 1). Alternatively, the controller 200 may be implemented in a distributed manner, such as in each of the luminaires 111-113. In this case, each luminaire 111-113 may receive the lighting script 250 and locally process it using the local instance of the processor 202 in order to determine its own lighting setting(s).

The controller 200 may also be implemented on a cloud computing system (i.e. one or more remote computing devices such as servers). In these cases, the method steps described herein are performed on the cloud and only final light commands are sent to the user system in order to control the luminaires 111-113.

A lighting script (also called a "light script", or just "script") contains multiple blocks of data defining lighting effects at particular points in time. The script is generally written by a script writer who designs the lighting effects to match a particular piece of media content such as a film such that when the script is played out by a script interpreter, the luminaires controlled by the interpreter render the designed lighting effects at the appropriate points during the film. In this sense, it is similar to how subtitles work in that the subtitles are defined in a separate file which is concurrently played back by the entertainment system.

The script is received by the controller 200 and interpreted in order to control the luminaires. There are some alternatives for this: the script can be streamed from an external device (e.g. a cloud device) so the controller 200 only has a part of the script relevant for a particular time window; or the script can be preloaded, i.e. the whole script is first processed and then sent to the controller 200 which stores it locally in order to play it back along with the displayed content.

In the lighting script 250, a timestamp is used to reference the particular location in the media content. For each time value there is defined a lightstate, multiple lightstates, or an effect (or nothing).

A lightstate may be: light on, brightness at 25%, color at green;

Multiple lightstates could be a 'from-to' description, for example: from brightness 1% to brightness 20% in 1500 ms;

An effect may be a complete curve to render on a target. For example: 'explosion' or 'thunder'. That may contain multiple keyframes to be executed on the target at a set interval (in this sense an effect is similar to multiple lightstates—just predefined).

Figure 10:
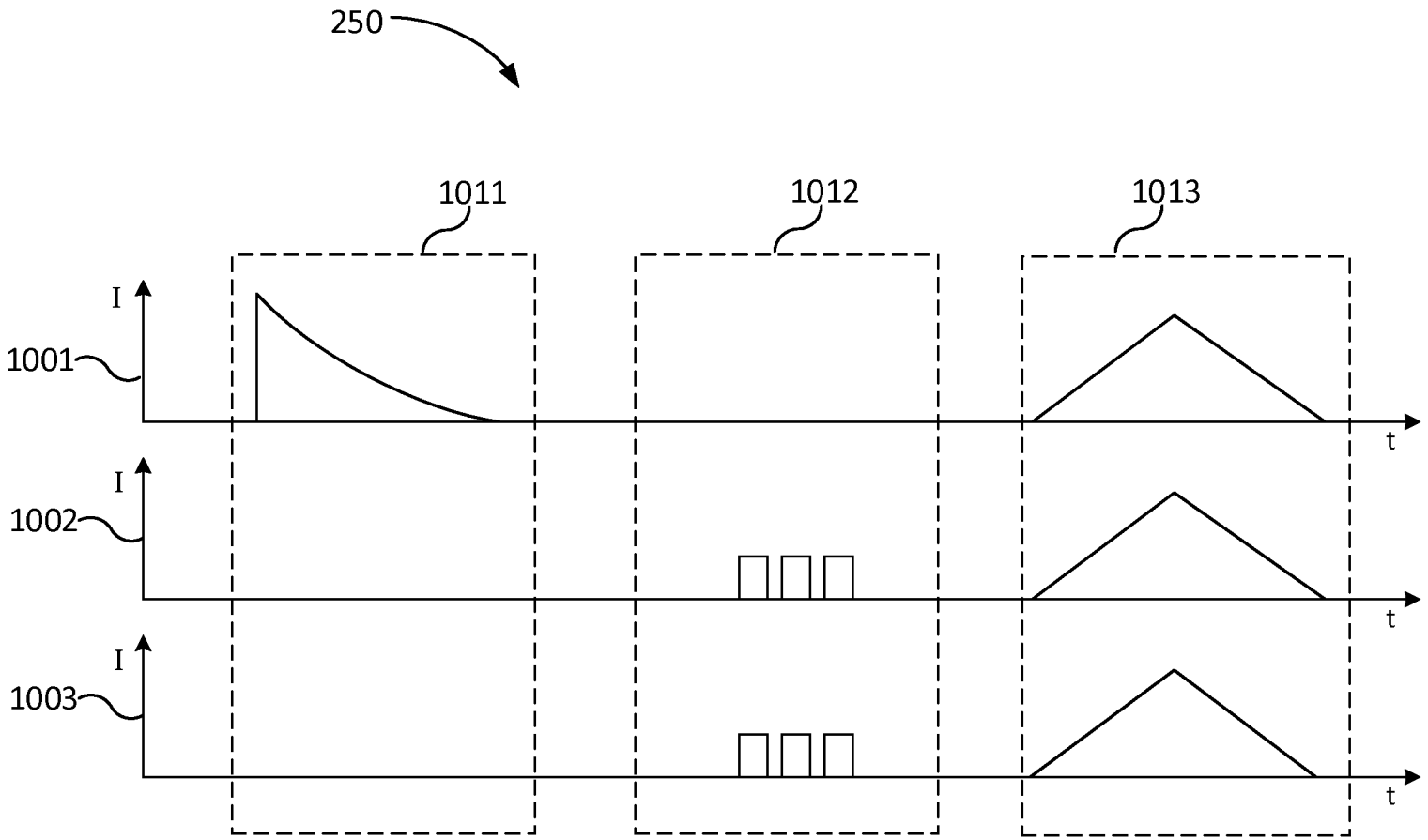
FIG. 10 shows a diagrammatic representation of an example lighting script.

The term "curve" here refers to a general effect to be rendered which comprises a plurality of light settings defined as a function of time. This is shown in FIG. 10 wherein the lighting script 250 is visualized as a function 1001-1003 over lighting settings over time for each respective channel (1001, 1002, 1003 in this example, e.g. "left" "center" and "right"). Each curve is a varying intensity (as shown in FIG. 10, but may be a different light property such as color) over time. Each lighting effect may comprises a non-zero section of this function which may be for a single channel as in the first lighting effect 1011, two channels as in the second lighting effect 1012, a plurality but not all of the channels (not shown), or all the channels as in the third lighting effect 1013. Note that in this representation of the script 250, parameters which can be altered during the scaling include the height of the curve, the duration of the curve, and the number of luminaires/channels on which the curve is to be rendered.

In addition to defining lightstates (note that these are also called lighting effects), the lighting script defines a "target" for each lightstate. The target is the luminaire(s) which are to be controlled to render the state defined in the script, and may be a single lamp or a group of lamps. The target may be hard-referenced as a specific one or more luminaires (e.g. "lamp with ID 1"), or soft-referenced by some other criterion such as a location within the environment 100 or a capability of the luminaires (e.g. lamps in the left corner, or lamp with color capabilities).

The actual rendering of the effect can happen in two ways:

The controller 200 pre-renders the effects depending on the configuration/setup of the lights and the system and maps them on the lights, and as such creates a library of rendered effects (macro streaming functions), which are mapped at the moments in time. The pre-rendered effects can be stored in memory 203 such that the processor 202 is able to retrieve the (already) pre-rendered effects and control the luminaires accordingly. This requires lower performance during playback of the script 250, but is more intensive on memory resources. However, this cannot be performed for entertainment content which is not available ahead-of-time, as the order of light effects there is not known. For example, gaming content is dynamically rendered and so the accompanying lighting effects cannot be pre-rendered in their entirety. Note, however, that particular effects (e.g. explosion effects) could be pre-rendered even for gaming content and the like. In these cases, the game (entertainment content) indicates which effects will be used during gaming, and the controller 200 can prepare by pre-rendering these, even though it does not yet know when exactly they will be used. This will speed up the rendering when it is actually required due to gameplay.

The controller 200 dynamically renders/maps the effects during the execution of the script 250 (higher performance needed during rendering, but less intensive on memory resources, in contrast to the above) This can be performed in both cases, i.e. it works for both dynamic content such as gaming content, and for pre-known content such as a film.

As mentioned above, a problem occurs when there are many luminaires because the script designer may not have considered such a setup. For example, the script designer may have written into the script a lightstate such as "100% brightness" for a target of "luminaires in left corner", but the user's system may have a large number of luminaires in the left corner (perhaps ten, fifteen, or even more—it is not impossible that the user's system may comprise hundreds of luminaires). A traditional script interpreter would simply control all these luminaires to render 100% brightness, which may be overwhelming and not what the script designer had in mind at all.

It would therefore be desirable to provide methods of upscaling light effects focusing on the most impactful light transitions (from the user perspective), such that the performance of the system is not affected by the increased number of light sources.

Figure 3:
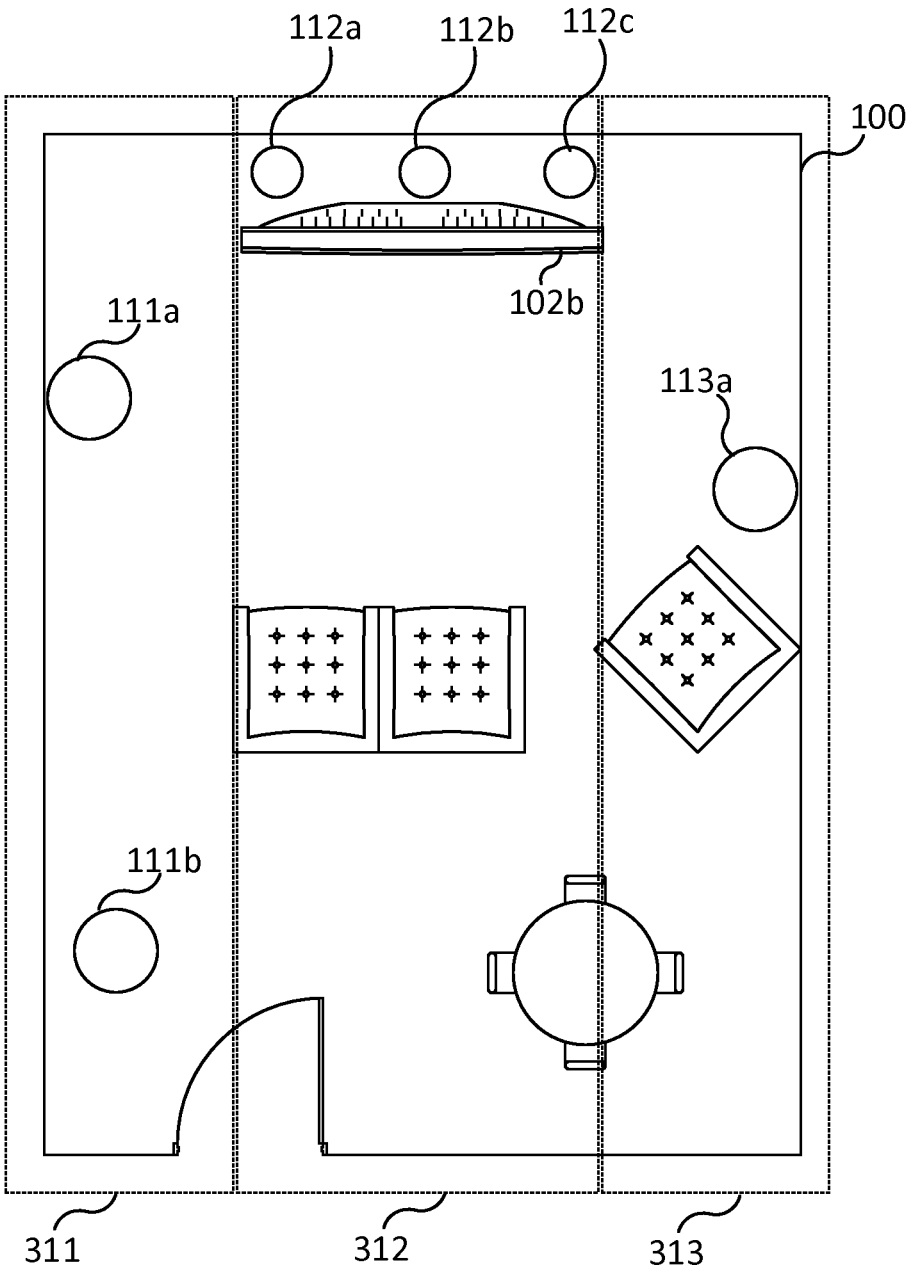
FIG. 3 shows a home entertainment setup with a greater number of luminaires.

FIG. 3 illustrates an entertainment system comprising more luminaires than that of FIG. 1. For the purposes of explanation, the system of FIG. 3 is shown as the same system as FIG. 1 but with additional luminaires.

In this case the luminaires 111-113 in the room 100 may be split into three "channels": a left channel 311 comprising luminaires 111*a* and 111*b*; a center channel comprising luminaires 112*a*, 112*b* and 112*c*; and a right channel comprising luminaire 113*a*.

Each channel may be connected to a respective one of the outputs 211-213 of the controller 200 but, as mentioned above, this would not avoid the scaling problem as each luminaire within a given channel would behave the same.

Figure 4:
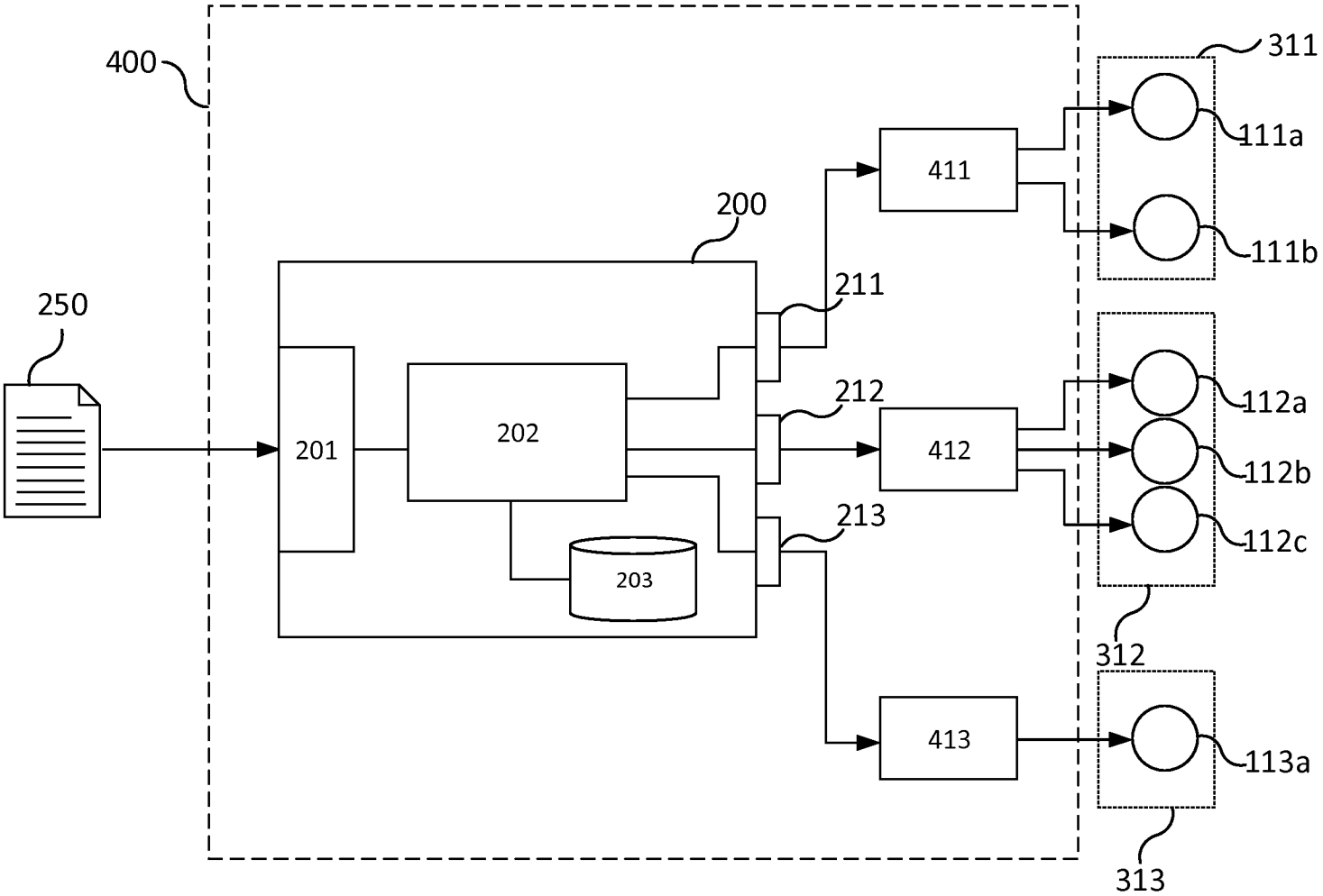
FIG. 4 shows a schematic of a lighting control system according to embodiments of the present invention.

Hence, the present invention augments the functionality of the control system 400 (comprising the controller 200) by introducing effect scaling modules 411-413 as shown in FIG. 4. Each scaling module 411-413 is connected to a respective one of the outputs 211-213. In FIG. 4, a first scaling module 411 is connected to a first output 211; a second scaling module 412 is connected to a second output 212; and a third scaling module 413 is connected to a third output 213.

Each scaling module 411-413 receives a signal from the respective output 211-213 and performs effect scaling as described herein to generate individual control signals for each of the luminaire(s) within its channel 311-313.

Note that the setup shown in FIG. 4 is entirely schematic in that the controller 200 itself is shown as a separate entity from the scaling modules 411-413 only for the purposes of explanation in order to make clear the modifications made to the traditional setup (comprising only the controller 200 itself, as in FIG. 2). Hence, it is appreciated that one or more of the scaling modules 411-413 may be implemented internally to the controller 200 itself, such as by way of code running on the processor 202. Similarly, the scaling modules 411-413 are shown as separate blocks, but it is appreciated that, for example, a single scaling module may be provided which receives data from all three outputs 211-213 and performs the functionality ascribed herein to the three individual scaling modules 411-413. This "single scaling module" may also be implemented internally to the controller 200 itself, in which case the controller 200 would simply comprise a single (logical) output per luminaire. What is important is that the lighting script 250 itself only defines lighting settings for a limited number of "channels" (e.g. three) and the control system 400 scales the lighting settings to be suitable for rendering on (many) more than this number (e.g. more than three).

Figure 5:
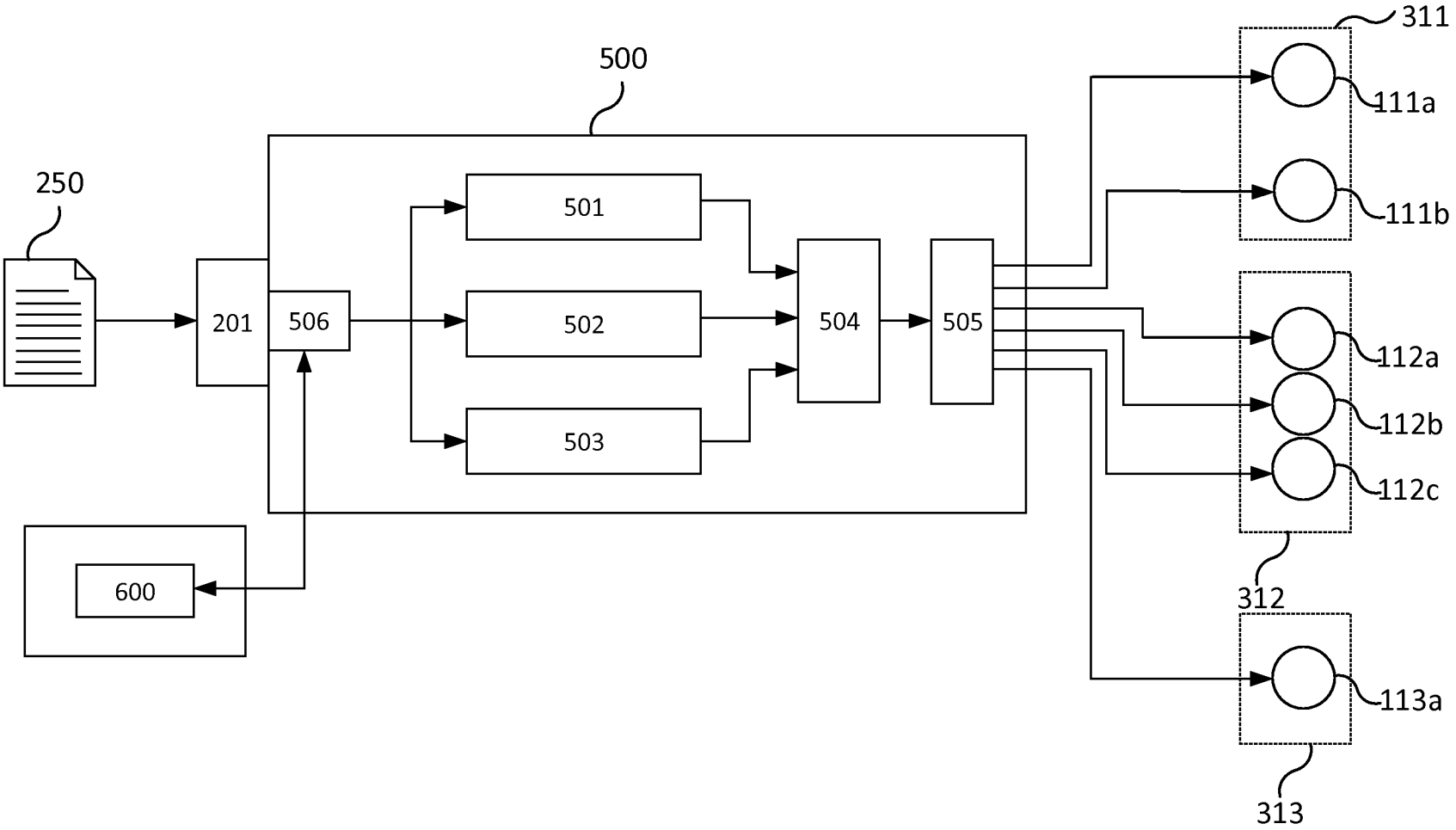
FIG. 5 is a functional block diagram of a lighting controller according to embodiments of the present invention.

FIG. 5 shows a high-level functional block diagram of a controller 500 in accordance with embodiments of the present invention.

The controller 500 comprises a script interpreter 506, an effect impact determining module 501, an effect scalability determining module 502, a luminaire sub-region determining module 503, a light effect scaler 504, and a lighting control module 505. The impact determiner 501, scalability determiner 502, and sub-region determiner 503 are all configured to receive the lighting script 250 via the input 201. They are also each configured to output data to the light effect scaler 504 which in turn outputs data to the lighting control module 504. Each of the determination modules 501-503 is configured to process the lighting script 250 in order to determine a respective property of each lighting effect defined in the script, as described below.

The script interpreter 506 is configured to receive the lighting script 250 via the input 201 and to interpret it for rendering on the luminaires. That is, the unprocessed script 250 itself is designed by a script designer and cannot generally be directly applied to the particular luminaires in the system. Hence, the script interpreter 506 processes the script 250 in order to determine actual effect values/time/locations etc. within the system in question. Doing so may require the interpreter 506 to access a library 600 storing effect data. For example, the script may define effects to be rendered on a channel (e.g. "left channel"), which is interpreted by the interpreter 506 in order to generate an interpreted output which specifies the actual luminaire(s) which are to render that effect. The interpreter 506 may also transform effects specified in terms of human-level settings (e.g. "red") into values usable by the other modules of the controller 500 (e.g. hex color codes such as "FF0000").

The impact determiner 501 is configured to process the interpreted lighting script 250 received from the interpreter 506 to determine a respective impact of the lighting effect on a human user, also called a "visual impact level". How "impactful" an effect is on a human user relates to how noticeable and perceptible it is to the user. This quality of the effect can be determined in a more object fashion by considering parameters of the effect which could affect the visual impact of the effect on the user when it is rendered. These include:

Location of the effect and light sources: e.g. differences in light effect perception based on the field of view of the user, e.g. many sources in the back of the user might be treated as single source as the impact is limited. This is described in more detail in relation to FIG. 9 below;

Priority or other indication of expected impact of the effect: the script 250 may define a respective "priority" for each of the effects therein. This can be used by a traditional controller 200 in order to determine which effect to render in case of conflicts, but can be considered as an indication of the impact of the effect. I.e. higher priority effects are considered to have a higher impact level. Other indications, such as an explicit indication, may be present in the script 250 which indicate the expected visual impact level of the respective effect;

Type of the light effect: e.g. if a light effect does not have scaling defined then it is either played on one light from the group or on all lights in the group treated as one;

Dynamics of the effect: lighting effects defined in the lighting script 250 may be static or dynamic (i.e. lighting effects which change over time). The dynamics of an effect can be used as an indication of the impact of the effect: slow effects are less impactful than high speed effects. Hence, in general a dynamic effect will be considered more impactful than a static effect (having no dynamics).

If controller 200 is unable to keep up it, can roll back to options that require less resources such as grouping the light and using them as a single light source. In some cases, such as gaming or potentially for a streamed script, impact cannot be predicted (known upfront), so the controller 200 may have already starting playing an effect when the next effect needs to be rendered. If this next effect has a higher priority than the first, but resources of the system are already taken (i.e. processing resources), then instead of simply skipping this effect completely, it can be played with a limited number of luminaires or with simplified rendering, which both require lower processing resources.

The effect scalability determining module 502 is configured to process the interpreted lighting script received from the interpreter 506 to determine a respective scalability of the lighting effect. This can be explicitly defined in the script 250, e.g. if a creator of the script 250 decided to provide information therein which predefines how the effect should be scaled, or if the effect is a standard effect from a library then the scalability may be predefined.

If the scalability is not predefined in either a library or the script 250 itself, the controller 200 determines this itself (which it may also do even if the scalability is predefined, though preferably not).

A scalable effect is an effect that has a defined way of how it can be scaled spatially and/or temporally (e.g. it can be described by a generic formula, or set of rules). For example, the lighting effect may be defined as a mathematical function of location and time: f(x,y,t), where f is for example brightness and/or color. A specific example of this is that a "global flash" effect with a bright lighting effect emanating radially outwards from a center (at the origin of whatever coordinate system is used) can be defined by the brightness function: f(t, x, y)=(c/(1+square root(x^2+y^2)))*t where c is a constant.

The luminaire sub-region determining module 503 is configured to access luminaire location information and thereby determine a subset of the luminaires which are within the sub-region of the lighting effect.

The light effect scaler 504 receives the properties determined by each of the determination modules 501-503 as described above, and processes them to determine how to scale the light effect defined in the script appropriately (e.g. to avoid the problems mentioned above). The scaler 504 then instructs the lighting controller to control the luminaires accordingly.

Based on the number of factors defining "impactful" (see above) and the type of the light effect, the scaler 504 ("script rendering engine") can either decide to:

(1) reduce the virtual (addressable) size of the light setup by grouping light sources and treating them as a single light source or a limited number of groups;

(2) select a subset of light sources and render effect only on the selected sources;

(3) scale the effect such that all light sources are treated as individual light "pixels".

In a first example embodiment, only the impact determination module 501 is used. That is, the scaler 504 need only know the visual impact level of an effect in order to determine how to adapt the effect to solve the above-outlined problem. For example, if the effect is a highly dynamic effect of bright white flashing light (such as a lightning effect), the impact determination module 501 will determine that this is a highly impactful effect and indicate such to the scaler 504. The scaler 504 can then use this information to determine that this effect should be rendered on fewer luminaires to avoid it being an overwhelming experience for the user. The scaler 504 therefore then selects, for example, a single luminaire and controls it via lighting controller 505 to render the effect accordingly.

If available luminaires are identical, then which single luminaire is selected can be based on the locations of the luminaires e.g. the luminaire located in the center of the luminaire group (e.g. all on a given channel); it can also be chosen randomly from the group.

If available luminaires are not identical, then which single luminaire is selected can be based on whichever is the most capable to render such effect e.g. based on maximum/minimum brightness it can reproduce, color rendering capabilities, type of the light source (spot, diffused, etc.). The capabilities of each light source are easily determinable using known methods (e.g. acquired during a commissioning processes and stored in a memory accessible by the controller 200).

In summary, the criteria by which the single luminaire is chosen include:

Select a most capable luminaire;

Select a luminaire of which the position is closest to the desired effect position, for example luminaires on the ceiling are less suitable than luminaires directed at walls;

Select a luminaire with the highest lumen output capability;

Select a luminaire that is already 'on';

Select a luminaire that is not yet playing an effect;

Select randomly.

Figure 6:
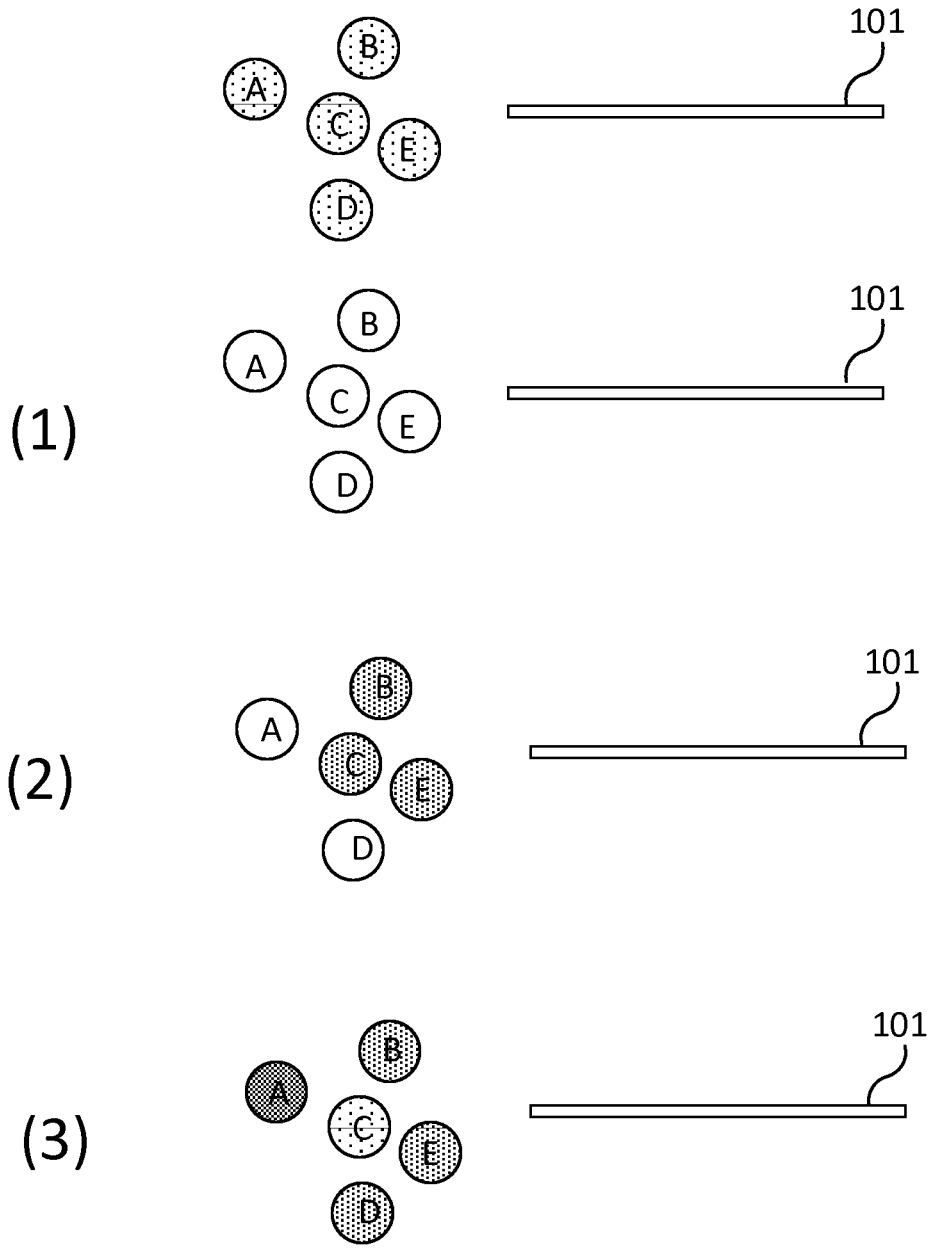
FIG. 6 illustrates scaling of a lighting effect.

In a second example embodiment, shown in FIG. 6, the script 250 contains the following information: location of the effect; size/scale factor of the effect; and priority/importance of the effect. The rendering engine 504 uses these three parameters to decide how to render the effect. In addition to these parameters the engine 504 uses the relative locations of the luminaires toward the user, and the number of light sources associated with a specific location (e.g. XYZ coordinate) or an area (e.g. left of the TV, below TV, behind the user, etc.). Methods for determining the location of each luminaire (e.g. on a map or floorplan of a room) are well known in the art and so not described here in detail. Note however that these location values may be commissioned ahead of time and stored in a local memory such as memory 203 for use by the processor 202.

If the user has five luminaires A-E as shown in FIG. 6 on the left of the TV 101, the following cases are possible:

(1) the effect is low priority and not scalable (e.g. single white flash), the scaler 504 selects all five lamps to play the flash simultaneously. In FIG. 6 this is illustrated by the effect being rendered on all luminaires A-E.

(2) the effect is high priority, with defined color (e.g. single red flash) then the scaler 504 selects a subset of the five lamps that can render the given red color and these selected lamps are used as a single light source. In FIG. 6 this is illustrated by the effect being rendered on luminaires B, C and E.; alternatively, the scaler 504 can select a single lamp (e.g. luminaire C) to render the flash effect, preferably the specific one of the lamps is particularly suited to rendering the effect due to being central in the group, or brightest, etc.

(3) the effect is scalable and high priority (e.g. explosion or lightning effect as mentioned above), then the scaler 504 selects one light source as a starting point of the effect and other four light sources are treated as pixels that are part of the effect, and controlled according the scaling defined by the explosion effect. This is illustrated in FIG. 6 by the effect being rendered on luminaire C first, followed by luminaires A, B, D and E. Some effects can be described by the generic formula making them highly scalable. This makes it easy to upscale them irrespective of number of luminaires. Scaling here refers to this "scaling formula". For example: explosion can be described as following—location of the center of the explosion, and the speed with which the explosion grows. No matter how many luminaires the user system happens to comprise, if enough processing resources are available, it is easy for the controller 200 to calculate how the effect will scale. For an explosion, it will simply first flash the luminaire closest to the desired center defined in the script, and then, based on the distance of other luminaires and speed of explosion flash also defined in the script, all other luminaires in sequence (possibly within and up to a maximum radius defined in the script, or default radius).

If an effect is to be rendered which has priority (over currently-rendered effects), and the effect may be enhanced by rendering it on more luminaires, then the controller 200 can do so, provided that the necessary processing resources are available (also mentioned above).

Figure 7:
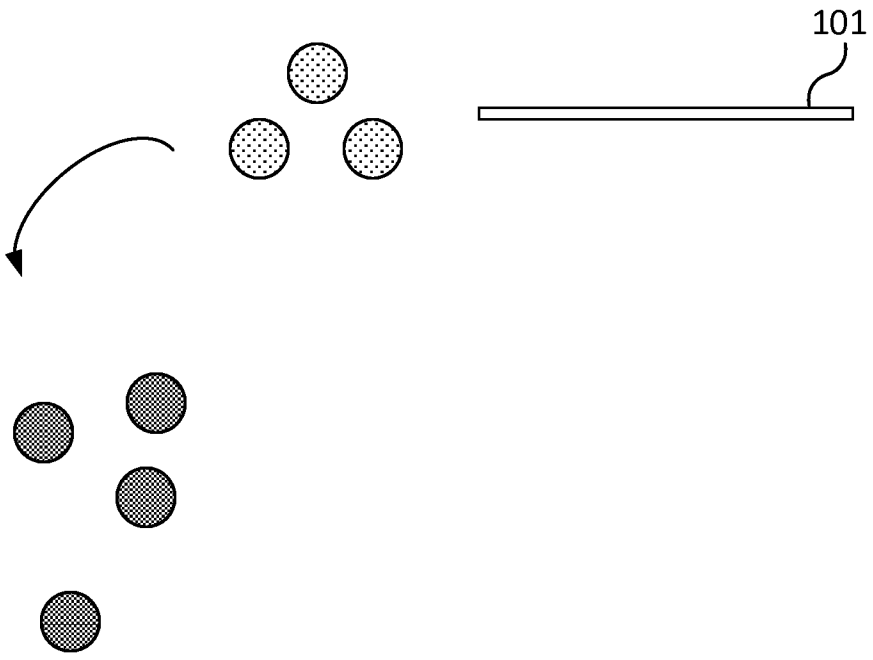
FIG. 7 illustrates scaling of a lighting effect.

A scalable effect can also be rendered on groups of lamps (e.g. an explosion) and groups of lamps can be treated as one pixel (FIG. 7). Instead of treating each luminaire individually, the controller 200 can partition them into groups, each having a characteristic location (e.g. center), and then treat them as individual luminaires in the way similar to described above.

Figure 8C:
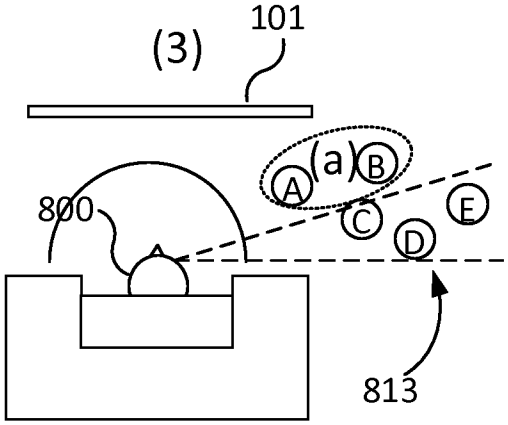
FIGS. 8A-C illustrate scaling of a lighting effect.
Figure 8B:
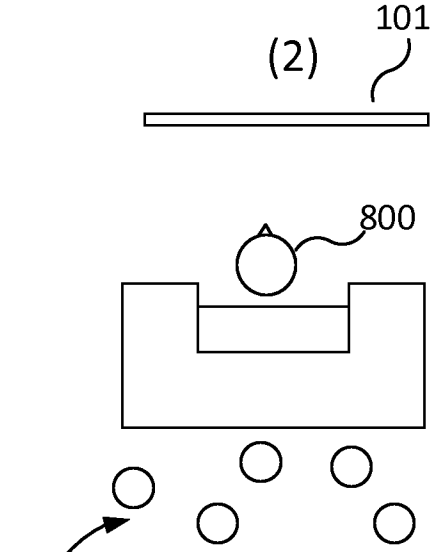
Figure 8A:
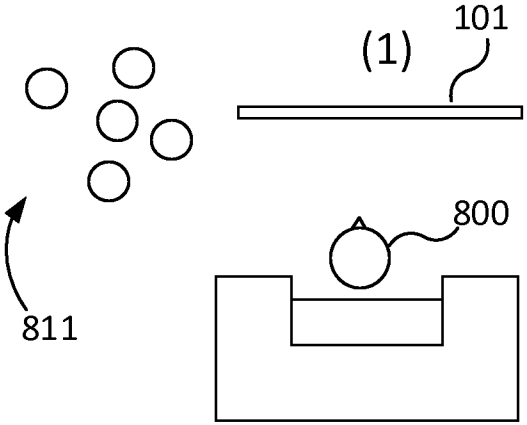

In another embodiment the location of light sources relative to the user might define how the upscale is performed by the scaler 504. FIGS. 8A-C show three different situations in which the user 800 is watching a movie on his TV 101, but with different lighting system setups.

The first case, in FIG. 8A, is similar to the one described above, with the luminaires 811 being in direct view of the user 800 and thus upscaling can be defined by other factors (see above).

In the second case, in FIG. 8B, the luminaires 812 are not directly visible to the user 800 thus a simple way of upscaling i.e. either selecting one lamp or treat all lamps as a single group is preferable.

In the third case, in FIG. 8C, the lamps 813 to render the effect are selected more precisely based the fact that human color perception is confined to a central region of the field of view. That is, colors are not perceived well in the peripheral vision region. This means that, for example, a white flash effect can be played using the whole group as single light source (because there is no color component), while a colored flash effect is only worthwhile rendering on lamps that are sufficiently within the field of view of the user 800. In the figure, luminaires C, D and E are outside the color-perception range of the user 800 and so the scaler 504 may determine to render a colored effect only on the other luminaires (A and B), saving power.

Similarly, if the luminaires are to be used to display a slow but colorful atmosphere effect, the same group (luminaires A and B only) should be used. If the atmosphere effect is based more on brightness level than on color level, the complete group (all luminaires 813) should be used. Moreover, for the case in FIG. 8C, any global effects that involve fast changes in brightness could be smoothened or not played at all as they might be perceived to be too distracting (peripheral vision).

Figure 9:
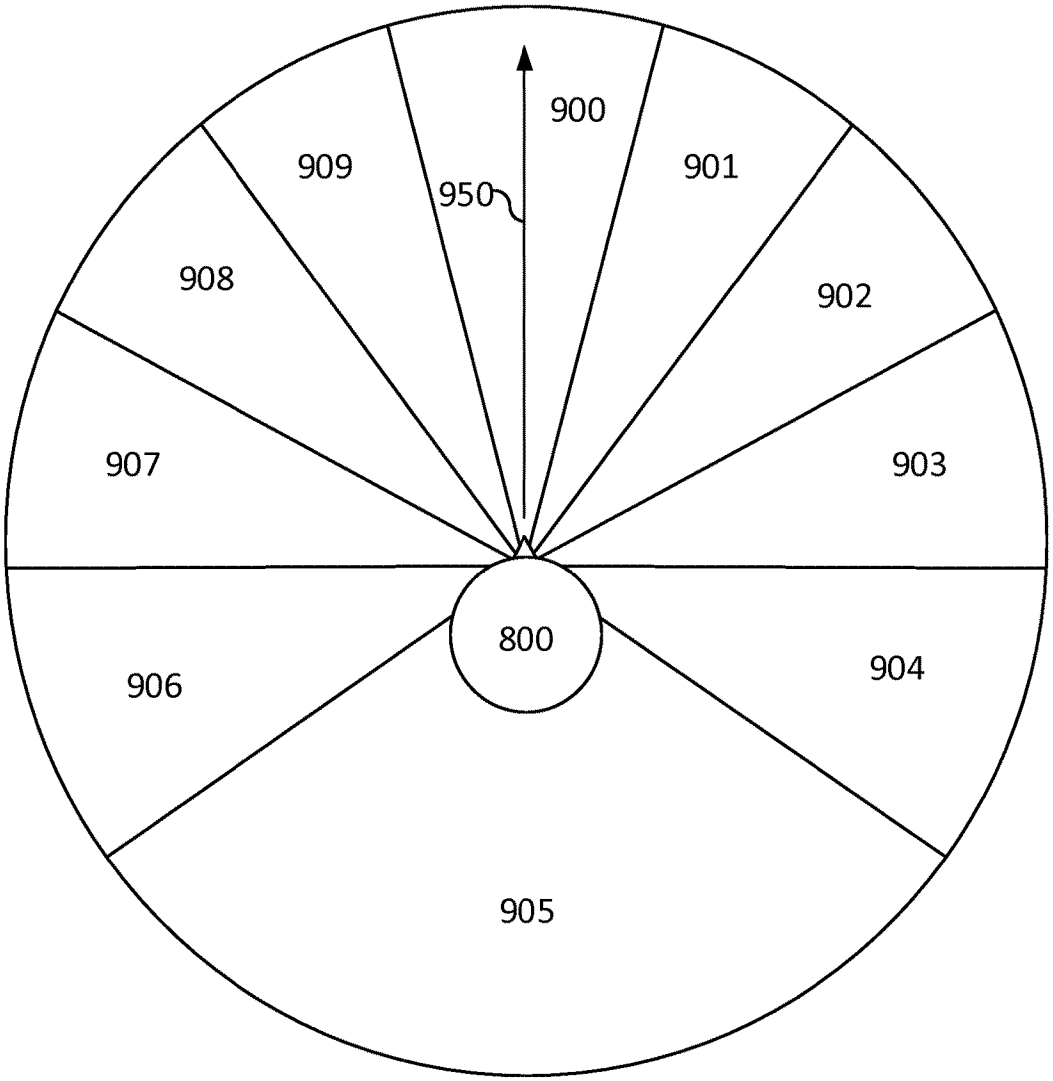
FIG. 9 shows the variation in impact of a lighting effect on a human user as a function of angular position relative to the human user's field of view.

FIG. 9 is a diagram illustrating how the impact determining module 501 can use the location of the effect (i.e. the location of the luminaires to render the effect, as defined in the script) relative to the user 800 as an indication of the visual impact level. In this example, the space around the user 800 is divided into regions (ten regions 900-909 in this example) by angle in the transverse plane.

Changes to an effect can be made to the brightness, the number of luminaires, or both. Each region 900-909 can be assigned a target modification factor (e.g. 1 for region 900, as it is directly in front of the user 800; 3 for regions 907-908 and 902, 903, as they are to the side of the user's viewing direction 950; 5 for regions 906, 905; and 10 for region 905 as it is behind the user 800) which defines how much the scaler 504 should amplify the impact of an effect in that region. For example: a 'candle effect' that is rendered in the field of view of the user where the impact is high, does not have to be modified. However, when it is rendered behind the user, it has to be modified, and the brightness might have to be increased by tenfold to have the same outcome for the user. However, note that highly dynamic effects are preferably not scaled since rapid change in brightness in the periphery and the back of the users can be perceived as very distracting and could have negative impact on the overall experience.

It will be appreciated that the above embodiments have been described only by way of example. Other variations to the disclosed embodiments can be understood and effected by those skilled in the art in practicing the claimed invention, from a study of the drawings, the disclosure, and the appended claims.

For example, embodiments of the present invention have been described in relation to the "additional functionality" provided by the scaler 504. In further embodiments, the processing load on the processor 202 can be taken into account by the scaler 504 (which runs on the processor 202) in determining whether or not to perform any scaling. That is, the act of determining the impact of the effect and how to scale it accordingly requires processing resources and hence, if the system is running at high capacity, this may have a detrimental effect on the rendering lighting effects. This is undesirable. Hence, it is preferably for the scaler 504 to "turn off" (i.e. to cease scaling) if it determines that the processing load is high (e.g. above a threshold load).

In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A controller for a lighting system, the lighting system comprising one or more luminaires associated with a lighting channel; the controller comprising:

an input for receiving a lighting script defining lighting effects to be rendered on the lighting channel;

a script interpreter configured to interpret the lighting script for rendering on the luminaires;

an effect impact determining module configured to determine a visual impact level of each of the lighting effects if rendered by the plurality of luminaires associated with the lighting channel as defined by the lighting script unmodified;

a script modifier configured to selectively generate, based on the visual impact levels, effect modification data for modifying at least one of the lighting effects to modify its visual impact level, wherein the script modifier is configured to only generate the effect modification data if the visual impact level of the lighting effect is above a threshold visual impact level such that when the visual impact of the lighting script unmodified is overwhelming to a human visual system, and wherein said modified visual impact level is a reduced visual impact level;

a lighting controller configured to control the luminaires associated with the lighting channel to render versions of the lighting effects defined by the lighting script, wherein the lighting controller is configured to use the effect modification data to render a modified version of the at least one lighting effect, having the modified visual impact level, from at least one of the luminaires.

2. The controller according to claim 1, wherein said modification data defines a modification to one or more of: a number of luminaires on from which the lighting effect is to be rendered by the lighting controller; a brightness of the lighting effect; a color of the lighting effect; a dynamic range of the lighting effect; a dynamic frequency of the lighting effect.

3. The controller according to claim 1, wherein the lighting system further comprises further pluralities of luminaires each associated with a respective lighting channel, the script defining lighting effects for each channel for which modification data are selectively generated.

4. The controller according to claim 1, the controller determining visual impact level; wherein the visual impact level of the lighting effect is based on one or more of:

an angular position of the luminaires on the channel or the lighting effect if rendered by the luminaires relative to a field of view of the human user;

an indication of an expected visual impact level specified in the lighting script;

a type of the lighting effect;

temporal dynamics of the lighting effect;

a number of luminaires on the channel;

an expected brightness of the lighting effect if rendered unmodified by the luminaires on the channel; or a physical size of the luminaires.

5. The controller according to claim 1, wherein said determining one or more of the luminaires on which to render the lighting effect comprises selecting a greater number of luminaires if the lighting effect is determined to have a low visual impact level and selecting a lower number of luminaires if the lighting effect is determined to have a higher visual impact level.

6. A controller according to claim 1, wherein the scalability of the lighting effect is based on determining that the lighting effect can be scaled spatially and/or temporally based on one or more of:

an indication in the lighting script that the lighting effect is scalable;

identifying that the lighting effect is defined in the lighting script by a mathematical formula which can be extended to an arbitrary number of luminaires.

7. The controller according to claim 1, wherein the visual impact level is a total power output by the luminaires if the lighting effect were rendered unmodified.

8. The controller according to claim 7, wherein the modified total power output is a reduced total power output.

9. A method of controlling a lighting system, the lighting system comprising one or more luminaires associated with a lighting channel; the method comprising:

receiving a lighting script defining lighting effects to be rendered on the lighting channel;

interpreting the lighting script for rendering on the luminaires;

determining a visual impact level of each of the lighting effects if rendered by the plurality of luminaires associated with the lighting channel as defined by the lighting script unmodified;

selectively generating, based on the visual impact levels, effect modification data for modifying at least one of the lighting effects to modify its visual impact level, wherein the effect modification data is generated if the visual impact level of the lighting effect is above a threshold visual impact level such that when the visual impact of the lighting script unmodified is overwhelming to a human visual system, and wherein said modified visual impact level is a reduced visual impact level;

controlling the luminaires associated with the lighting channel to render versions of the lighting effects defined by the lighting script, by using the effect modification data to render a modified version of the at least one lighting effect, having the modified visual impact level, from at least one of the luminaires.

10. The method according to claim 9, wherein said modification data defines a modification to one or more of: a number of luminaires on from which the lighting effect is to be rendered; a brightness of the lighting effect; a color of the lighting effect; a dynamic range of the lighting effect; a dynamic frequency of the lighting effect.

11. The method according to claim 9, wherein said modified visual impact level is a reduced visual impact level.

12. The method according to claim 9, wherein the lighting system further comprises further pluralities of luminaires each associated with a respective lighting channel, the script defining lighting effects for each channel for which modification data are selectively generated.

13. A computer program product comprising computer-executable code embodied on a computer-readable storage medium configured, so as when executed by one or more processing units, to perform the steps according to method claim 9.

* * * * *